US010352034B2

(12) United States Patent
Boyle et al.

(10) Patent No.: US 10,352,034 B2
(45) Date of Patent: Jul. 16, 2019

(54) RAPID ASSEMBLY STORAGE BUILDING USING SHIPPING CONTAINER BUTTRESSES

(71) Applicant: WISYS Technology Foundation, Inc., Madison, WI (US)

(72) Inventors: Philip Boyle, Oshkosh, WI (US); Luke Cernak, Sheboygan, WI (US); Jon Fuller, Kimberly, WI (US); James Krych, Bellevue, WI (US)

(73) Assignee: WiSys Technology Foundation, Inc., Madison, WI (US)

( * ) Notice: Subject to any disclaimer, the term of this patent is extended or adjusted under 35 U.S.C. 154(b) by 0 days.

(21) Appl. No.: 15/873,542

(22) Filed: Jan. 17, 2018

(65) Prior Publication Data

US 2018/0209135 A1 Jul. 26, 2018

Related U.S. Application Data

(60) Provisional application No. 62/449,324, filed on Jan. 23, 2017.

(51) Int. Cl.

| | |
|---|---|
| ***E04B 1/348*** | (2006.01) |
| ***E04B 1/19*** | (2006.01) |
| ***E04H 1/02*** | (2006.01) |
| ***E04H 1/00*** | (2006.01) |
| *E04H 1/12* | (2006.01) |

(52) U.S. Cl.

CPC ..... *E04B 1/1906* (2013.01); *E04B 1/3483* (2013.01); *E04H 1/005* (2013.01); *E04H 1/02* (2013.01); *E04B 2001/1978* (2013.01); *E04B 2001/1993* (2013.01); *E04B 2001/34884* (2013.01); *E04H 2001/1283* (2013.01)

(58) Field of Classification Search

CPC ..... E04B 1/3483; E04B 2001/34884; E04B 2001/34892; E04B 7/022; E04H 2001/1283; E04H 1/1205; E04H 1/005

See application file for complete search history.

(56) References Cited

U.S. PATENT DOCUMENTS

| | | | | |
|---|---|---|---|---|
| 5,884,824 A * | 3/1999 | Spring, Jr. | ..... | B60R 9/042 224/309 |
| 5,966,956 A * | 10/1999 | Morris | ..... | F25D 11/003 52/69 |
| 6,131,781 A * | 10/2000 | Murray | ..... | B60R 9/042 224/309 |
| 7,310,914 B1 * | 12/2007 | Moore | ..... | E04B 1/3483 52/289 |
| 8,091,291 B2 * | 1/2012 | Ode | ..... | A01G 9/14 52/643 |
| 8,800,238 B2 * | 8/2014 | Davies | ..... | E04B 7/022 52/641 |

(Continued)

*Primary Examiner* — Brian E Glessner
*Assistant Examiner* — Daniel J Kenny
(74) *Attorney, Agent, or Firm* — Boyle Fredrickson S.C.

(57) ABSTRACT

A building technique uses standard shipping containers as buttresses to support a truss system that may extend between the shipping containers to provide a roof. A sliding connector system attaches the trusses to the shipping containers to accommodate variations in separation of the shipping containers presenting a versatile framing system that is insensitive to site-related variations.

22 Claims, 8 Drawing Sheets

(56) References Cited

U.S. PATENT DOCUMENTS

| | | | | |
|---|---|---|---|---|
| 2006/0207193 | A1* | 9/2006 | Lilke | E04B 1/3483 52/79.7 |
| 2008/0110105 | A1* | 5/2008 | Boschma | E04B 1/342 52/80.2 |
| 2011/0036018 | A1* | 2/2011 | Hsu | E04B 1/3483 52/2.19 |
| 2014/0008359 | A1* | 1/2014 | Ferren | B65D 88/121 220/1.5 |
| 2014/0325931 | A1* | 11/2014 | Prodaniuk | E04H 1/12 52/656.9 |
| 2015/0240474 | A1* | 8/2015 | Kokoschka | F02B 63/044 52/79.1 |
| 2016/0130795 | A1* | 5/2016 | Downey | E04H 5/00 52/79.1 |

* cited by examiner

RAPID ASSEMBLY STORAGE BUILDING USING SHIPPING CONTAINER BUTTRESSES

CROSS REFERENCE TO RELATED APPLICATION

This application claims the benefit of U.S. provisional application 62/449,324 filed Jan. 23, 2017 and hereby incorporated by reference.

STATEMENT REGARDING FEDERALLY SPONSORED RESEARCH OR DEVELOPMENT

N/A

BACKGROUND OF THE INVENTION

The present invention relates generally to a method and apparatus for rapidly constructing temporary storage facilities, and specifically to a system of building construction using standard shipping containers.

Shipping containers are widely used for the transportation of goods internationally and have standardized dimensions allowing them to be readily conveyed using a variety of different transportation modalities including ships, trains, and trucks. These containers are often called "intermodal" containers because of their versatility.

Intermodal shipping containers are normally constructed using a sturdy steel frame with corrugated steel side walls. Special fittings ("castings") are placed in the corners of the containers at precise locations to allow the containers to be stacked and locked with other similar containers in a "twist lock" fashion so they can be stacked, for example, on the decks of transport ships.

After a period of use, shipping containers are retired from shipping but still retain substantial strength. The availability of such containers, has led to their use in the construction of buildings, for example, by connecting multiple shipping containers together and cutting openings therebetween to construct a larger structure.

SUMMARY OF THE INVENTION

The present invention employs shipping containers for the construction of temporary shelters, but instead of using the shipping container volume as the structure volume, the invention uses the shipping container as an outer buttress wall to the structure. The standard dimensions of the shipping container allow truss structures to be attached to the shipping containers using standardized, reusable prefabricated components. The truss structure provides a roof to an interior volume arbitrarily larger than the shipping container volumes as defined by the separation of two containers. Attachment between the trusses and the containers may be by means of a rail system accommodating a range of building sizes with the same prefabricated structures as well as minor site-related variations.

Specifically, the present invention provides a building using a first and second shipping container separated along a first axis in spaced opposition flanking a building volume. Each of the shipping containers supports a set of rails extending parallel to the axis and releasably attached to upper surfaces of the shipping container. Connectors attach endpoints of a set of trusses to opposed corresponding rails on the first and second shipping containers, the connectors attachable to the rails.

It is thus a feature of at least one embodiment of the invention to make use of available shipping containers as a foundation for structures not limited by the volume of the shipping containers. It is another feature of at least one embodiment of the invention to make use of the standard external dimensions of shipping containers to create a set of reusable building components that can be rapidly installed on available shipping containers.

The connectors are adapted to releasably attach in a range of positions along the rails.

It is thus a feature of at least one embodiment of the invention to provide a building system using standard parts that can nevertheless construct different sizes of buildings by sliding the truss attachments along the top of the shipping containers and that can accommodate minor variations in the placement of the shipping containers which are ideally placed before assembly begins.

The connector may provide clamp surfaces receiving walls of the rails therebetween to slidably guide the connector along the rails and then to grip the rails with frictional force.

It is thus a feature of at least one embodiment of the invention to use a clamping mechanism that allows fine adjustment of the location of the ends of the trusses with respect to the shipping containers.

The rails may provide attachment to the shipping containers elevating the rails above a surface of the shipping container, and the connector provides downwardly opening clamp surfaces receiving side walls of the rails therebetween and wherein the lower ends of the clamp surfaces include holes for receiving bolts therethrough adapted to draw the clamp surfaces together beneath the rails to clamp the clamping surfaces frictionally to a rail.

It is thus a feature of at least one embodiment of the invention to provide a simple mechanically advantaged clamp system using readily available bolts.

The clamp surfaces may be plates extending vertically downward from ends of the trusses.

It is thus a feature of at least one embodiment of the invention to provide a mechanically robust clamp design that can be integrated to the truss ends.

The rails may be steel tubes.

It is thus a feature of at least one embodiment of the invention to provide high-strength attachment points for the trusses that can distribute the loads of the trusses to solid points of attachment on the shipping containers.

The shipping containers may provide corner castings standardized for the shipping industry and at least one rail may attach between two corner castings.

It is thus a feature of at least one embodiment of the invention to exploit the precise dimensions of the attachment points used for shipping containers for predictably connecting prefabricated building components.

At least one rail may provide a hook at one end fitting within an upwardly open slot of a corner casting to engage an inner surface of the corner casting against upward motion of the rail.

It is thus a feature of at least one embodiment of the invention to permit rapid assembly of the building components to corner castings limiting the need for specialized tools or time-consuming assembly techniques.

At least one rail may provide a rotatable T fitting that may be received within an upwardly open slot of the corner casting and rotated to engage an inner surface of the corner casting against upward motion of the rail.

It is thus a feature of at least one embodiment of the invention to make use of the twist lock mechanism used for stacking shipping containers to support prefabricated building components.

The rotatable T fitting maybe attached to a sleeve that engages the at least one rail.

It is thus a feature of at least one embodiment of the invention to provide a simple joint system that can accommodate both a horizontal rail and a vertical rail aligned within the sleeve but oriented at right angles.

In this regard, the building may further include vertical beams attaching to facing walls of the first and second shipping containers at ends of the first and second shipping containers.

It is thus a feature of at least one embodiment of the invention to provide attachment points for end walls that can used to provide predictable termination at prefabricated end wall components.

The vertical beams may attach at both ends to vertically separated pairs of corner castings of the first and second shipping containers.

It is thus a feature of at least one embodiment of the invention to employ the standardized corner castings for both horizontal and vertical components of the building structure.

Some rails may provide downwardly extending fingers passing along the vertical sidewalls of the shipping containers and adapted to grip the vertical sidewalls of the shipping container against upward motion of the rail.

It is thus a feature of at least one embodiment of the invention to permit the attachment of intervening rails for support of trusses removed from the corner castings by taking advantage of standard container widths.

The lower ends of the fingers may include horizontally extending teeth for engaging corrugations in the sidewalls to limit motion perpendicular to the axis.

It is thus a feature of at least one embodiment of the invention to provide a method of anchoring the intervening rails against longitudinal motion.

The trusses may be gable trusses angling upward from each shipping container to an apex point positioned between the shipping containers.

It is thus a feature of at least one embodiment of the invention to provide a lightweight truss structure that can support anticipated snow and wind loads.

The gable trusses may be constructed of aluminum.

It is thus a feature of at least one embodiment of the invention to provide a truss structure that can be assembled without the need for specialized lifting equipment.

The trusses may further include channels for receiving and retaining polymer sheet material to cover an upper surface of the trusses as a roof. In one example, the sheet material may include keders and wherein the channels may provide keder channels for retaining the keders.

It is thus a feature of at least one embodiment of the invention to provide a rapid method of sheathing the structure using architectural fabrics.

These particular objects and advantages may apply to only some embodiments falling within the claims and thus do not define the scope of the invention.

DETAILED DESCRIPTION OF THE PREFERRED EMBODIMENT

Figure 1:
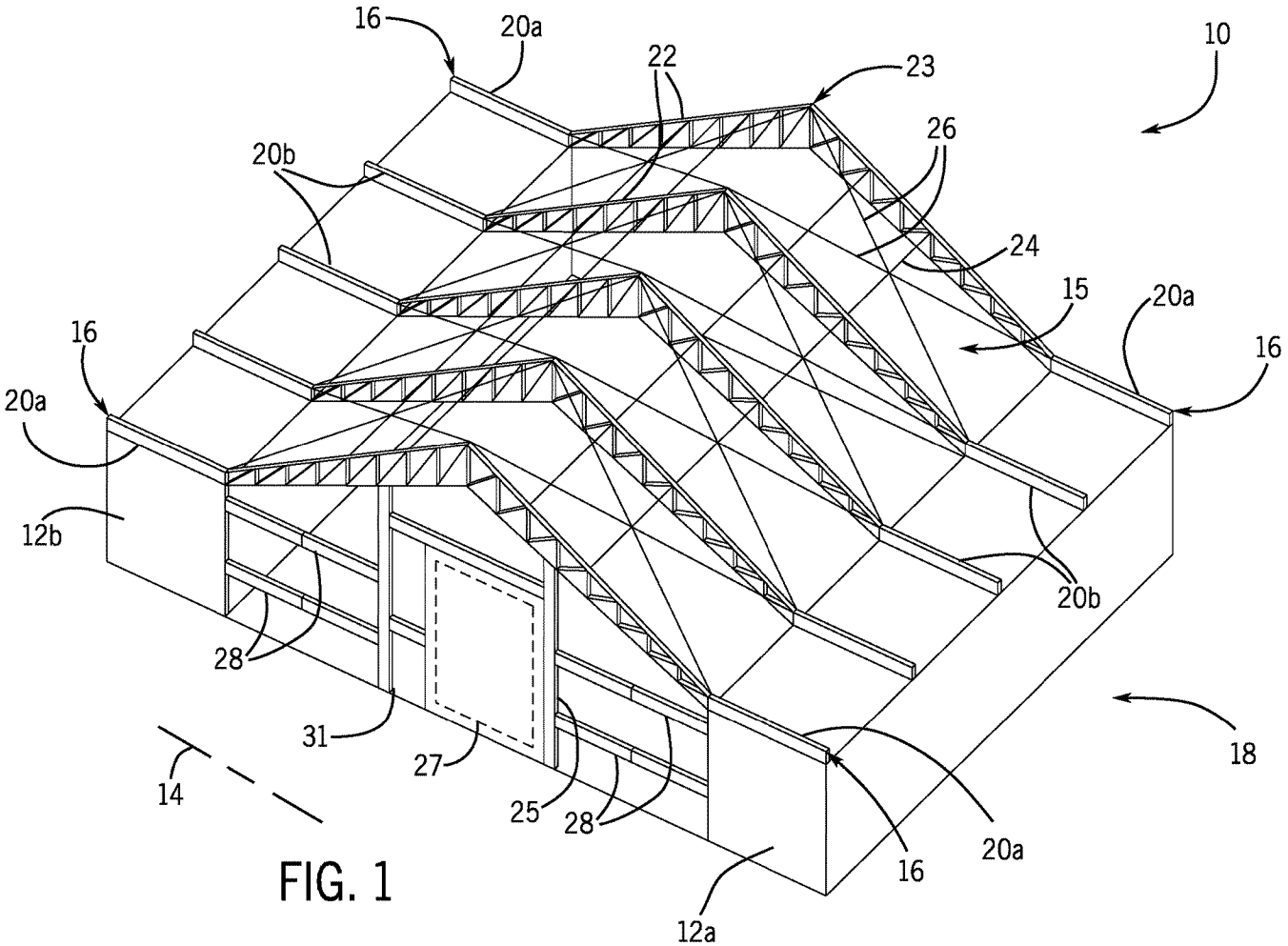
FIG. 1 is a perspective view of a structure constructed according to the present invention showing shipping containers positioned to flank a structure volume spanned by gabled trusses in sliding connection with the shipping container.

Referring now to FIG. 1, a structure 10, suitable for temporary storage may provide for a first and second shipping container 12*a* and 12*b* separated along a transverse axis 14, for example, by 40 feet, to flank a building volume 15. The shipping containers 12 may be placed directly on the ground 18 which may be groomed to be substantially level.

Generally, the shipping containers 12 may conform with ISO standard 668, Series 1 freight containers—classification, dimensions, and ratings 2013; 6:1-16. The height and length of such containers 12 may vary; however, the width of the containers 12 is fixed at eight feet and the height is usually 8½ feet. The longitudinal length of the containers 12, perpendicular to the transverse axis 14, may vary from 20 to 40 feet and multiple containers may be attached together (for example, using lashing bridge fittings) to extend this distance.

Each container 12 has a box-like frame of steel and corrugated sheet steel sides welded to the frame. The eight corners of the frame expose a special corner casting 16 of standard dimensions and locations as will be discussed below.

Referring still to FIG. 1, the upper horizontal walls of the containers 12 support transverse parallel spaced apart rails 20, for example, each rail 20 separated by 10 feet to provide five rails over the length of the shipping containers 12. The rails 20 have two styles, a first style of rail 20*a* being placed at the ends of the shipping container and a second style of rail 20*b* placed therebetween.

Gabled planar trusses 22 extend transversely between the rails 20 extending upward from each rail 20 to an apex 23 approximately ten feet above the tops of the containers 12 and substantially midway between the containers 12. Desirably, each truss 22 is constructed of aluminum and is limited in weight to less than 200 pounds and desirably less than 110 pounds for easy manual installation on-site.

Rigid longitudinal braces 24 may extend longitudinally between each truss 22, and diagonally extending wire cable 26 may connect between connection points, a first connection point being near the connection between the truss 22 and the rail 20, and the second connection point being near the apex 23 of an adjacent truss 22. The longitudinal braces 24 and wire cable 26 resist longitudinal motion of the trusses 22 and parallelogram distortion.

Vertically extending sidewalk of the structure 10 are formed by abutting vertically extending walls of the containers 12. Vertical end walls of the structure 10 may be formed by standard dimension prefabricated metal beams 25 (e.g., steel) framing a standard garage door 27 or the like and an adjacent personnel door 31. These prefabricated metal beams 25 may be joined to the containers 12 using telescoping beams 28 that accommodate different transfer widths of the structure 10 as will be discussed below.

The outer surfaces of the structure 10 may be clad with an architectural fabric of the type used for the construction of tents attached to the prefabricated components as will also be discussed below. Generally each of these components is reusable and may be shipped between sites rapidly, for example, with those components other than the containers 12 stored in one of the containers 12.

Figure 2:
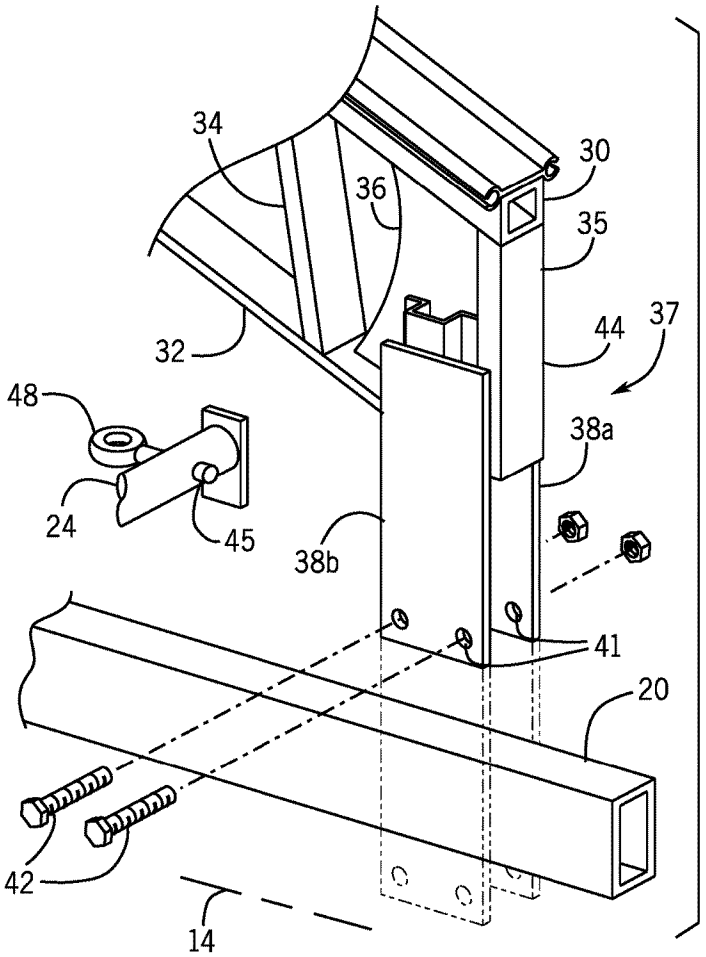
FIG. 2 is a fragmentary exploded perspective view of the sliding connection between the trusses and the shipping containers through connectors attached to rails.

Referring now to FIGS. 1 and 2, each of the trusses 22 will provide for upper and lower transversely extending chords 30 and 32, respectively, with the upper chord 30 constructed of 6061 aluminum square tubing and the lower chord 32 constructed of aluminum tubing with a circular cross-section. Zigzagging diagonal struts 34 extend between the upper and lower chords 30 and 32, which diverge slightly toward the apex 23, attach to the upper and lower chords 30 and 32 by welds. In one embodiment the trusses 22 may be divided into two components at a bolted vertical seam along an apex 23 for simplicity in shipping and handling.

Opposed ends of the upper and lower chords 30 and 32 are joined at each end by a vertical strut 35 (for example, welded between the upper chords 30 and lower chords 32) and a vertically extending web plate 36 welded to the upper chords 30, the lower chords 32 and the vertical strut 35 for added stiffness.

A coupling 37 is attached to each end of each truss 22 formed of pairs of opposed parallel clamp plates 38*a* and 38*b* extend downwardly from flanking sides of the front and back of the vertical strut 35 (as welded thereto) to provide a downwardly extending sleeve that may receive rail 20 attached to the upper surface of the cargo container 12. The clamp plates 38 may generally flank sidewalk of the rail 20 with the top of the rail 20 abutting the bottom of the vertical strut 35 and web plate 36 to provide a sliding connection between an end of the truss 22 and the rail 20 along the transverse axis 14.

Figure 3:
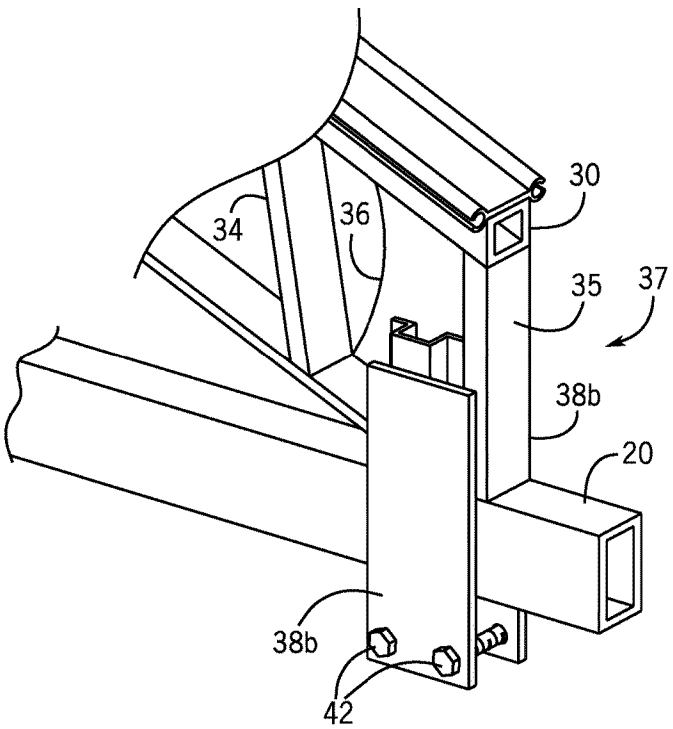
FIG. 3 is a figure similar to FIG. 2 with the connector attached to the rail and secured thereto.

Referring also to FIG. 3, longitudinally aligned holes 41 may be placed in the lower edges of the clamp plates 38, the latter of which extend below the rail 20. The holes 41 may receive carriage bolts 42 or the like which when tightened draw the clamp plates 38 tightly against the sidewalls of the rail 20 at an arbitrary transverse position on the rail 20 to prevent further transverse movement by promoting a high degree of frictional contact between the clamp plates 38 and the rail 20.

Referring again to FIG. 2, the web plate 36 may support an upwardly open rectangular pocket weldment 44 to receive a corresponding downwardly extending tab 45 attached at both ends of cross braces 24 allowing each cross braces 24 to be quickly attached to a truss 22 to extend between trusses 22. In this respect, the cross braces 24 may be a standard length of metal tubing, for example, approximately 10 feet in length, to match the separation between the rails 20. An eye-loop 48 may be attached to the ends of the cross braces 24 to accept attachment of one end and the diagonal wire cable 26 shown in FIG. 1. The other end of the diagonal wire cable 26 may be attached to a corresponding eye-loop (not shown) attached at an apex 23 of the truss 22.

Figure 4:
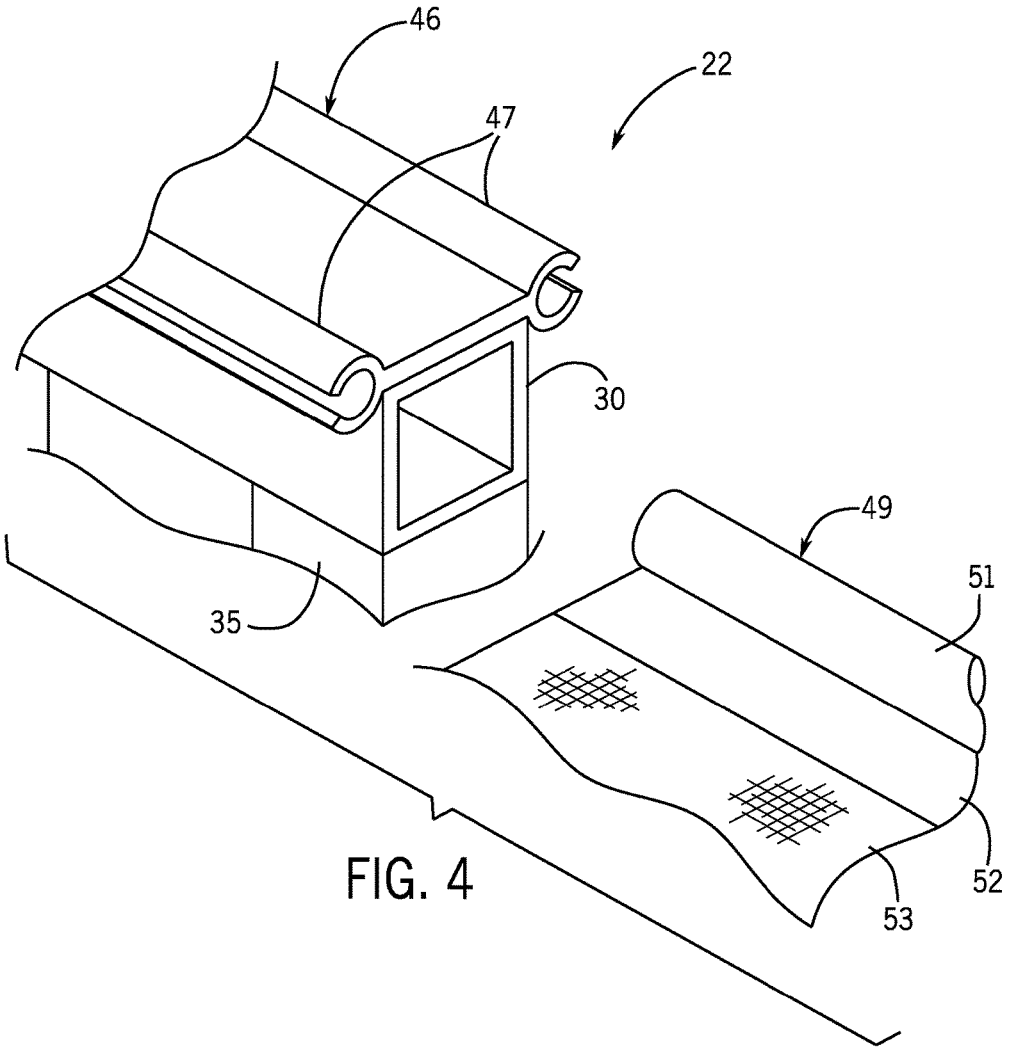
FIG. 4 is a fragmentary perspective view of a keder rail and keder for attachment of flexible roofing material between the trusses.

Referring now to FIGS. 2, 3 and 4, an upper surface of the upper chord 30 may support keder rail 46 providing open circular channels 47 facing in opposite longitudinal directions and extending along the entire upper edge of the truss 22. These channels 47 may receive a keder strip 49, the latter providing a circular cross-section edge strip 51, for example, provided by a flexible PVC tube, and in turn joined by an attachment strip 52 which may be glued or welded to a flexible architectural fabric 53 such as vinyl. In this way the architectural fabric 53 may be rapidly attached to the structural components of the structure 10. The fabric 53 may be sized to extend over the full 40-foot span of the trusses 22 and may make use of known materials for 10 construction such as a vinyl or fabric tent material.

Figure 5:
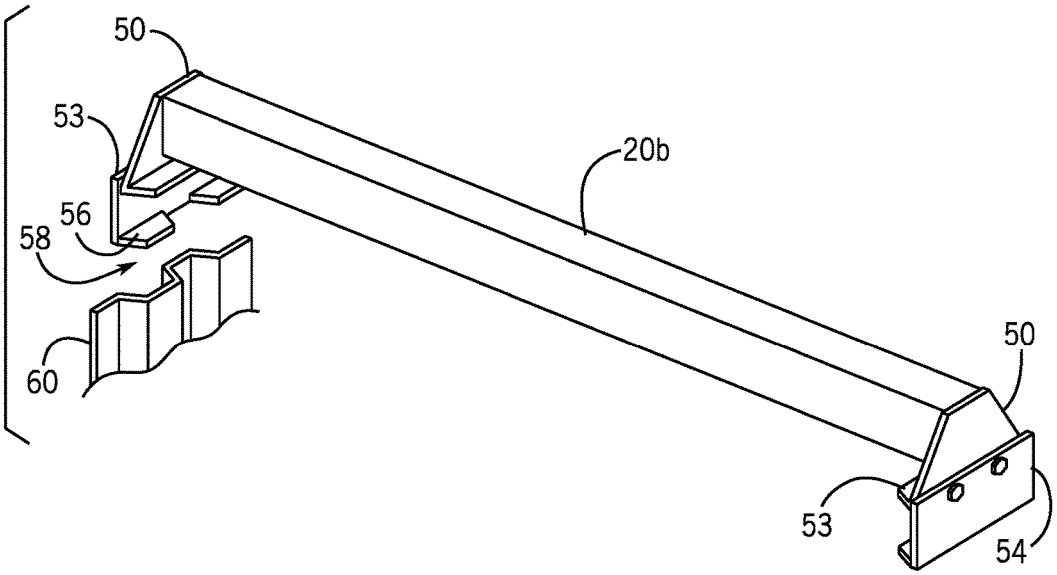
FIG. 5 is a perspective view of a first form of the rails of FIG. 2 and fragmentary portion of an outer wall of a shipping container having corrugations engaged by ends of the rails.
Figure 6:
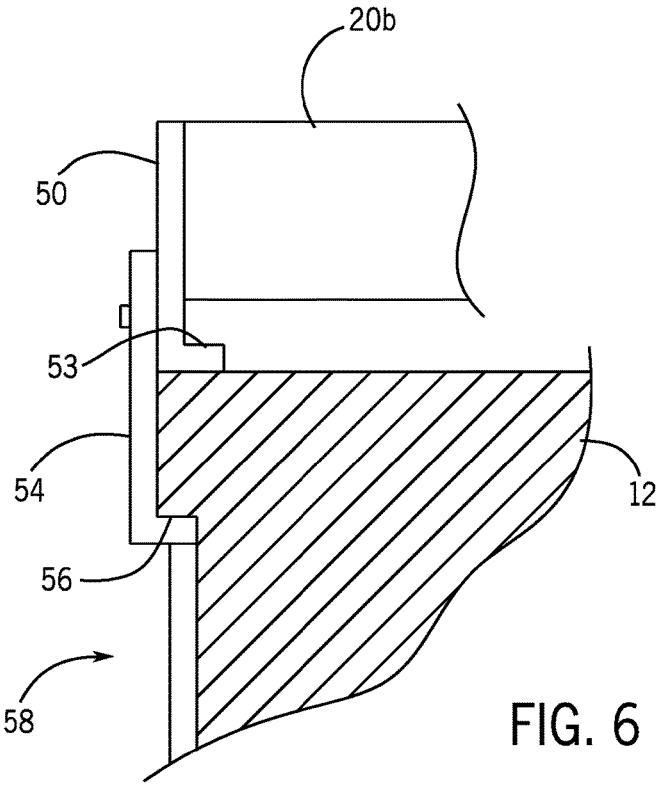
FIG. 6 is an elevational cross-section through the shipping container and rail of FIG. 5 showing attachment of an end of the rail to the shipping container.

Referring now to FIGS. 1, 5 and 6, the rails 20*b* on the upper surface of the containers 12, as noted above, may be in the form of a transversely extending rectangular steel tube that may receive the sliding coupling 37, shown in and described with respect to FIGS. 2 and 3, attaching the trusses 22 to the containers 12. Generally, the length of the rail 20*b* (and 20*a*) will be equal to the full transverse width of the containers 12 allowing adjustments of the sliding coupling 37 along the rails 20 to accommodate a separation of the shipping containers 12 (and hence a width of the internal volume 15) from 27 to 40 ft. without changing the length of the roof truss 22.

Each of the rails 20*b* may be attached at its ends to a vertically extending weldment 50 extending downward therefrom to terminate at an inwardly extending ledge 53 that may rest on top of the cargo container 12 to space the bottom of the rail 20*b* from the surface of the cargo container 12 allowing passage of the bolts 42 and clamp plates 38 slightly below that rail 20*b* discussed with respect to FIGS. 2 and 3.

A locking plate 54 may be bolted to the outside of weldment 50 to extend further downward therefrom and may include transversely inwardly extending teeth 56 which engage recesses 58 in the corrugated sidewalk 60 of the containers 12 to prevent longitudinal movement of the rail 20*b* when the locking plates 54 are attached to the weldments 50. Bolts are received within the vertically extending slots in locking plate 54 to allow a degree of vertical adjustment.

Figure 7:
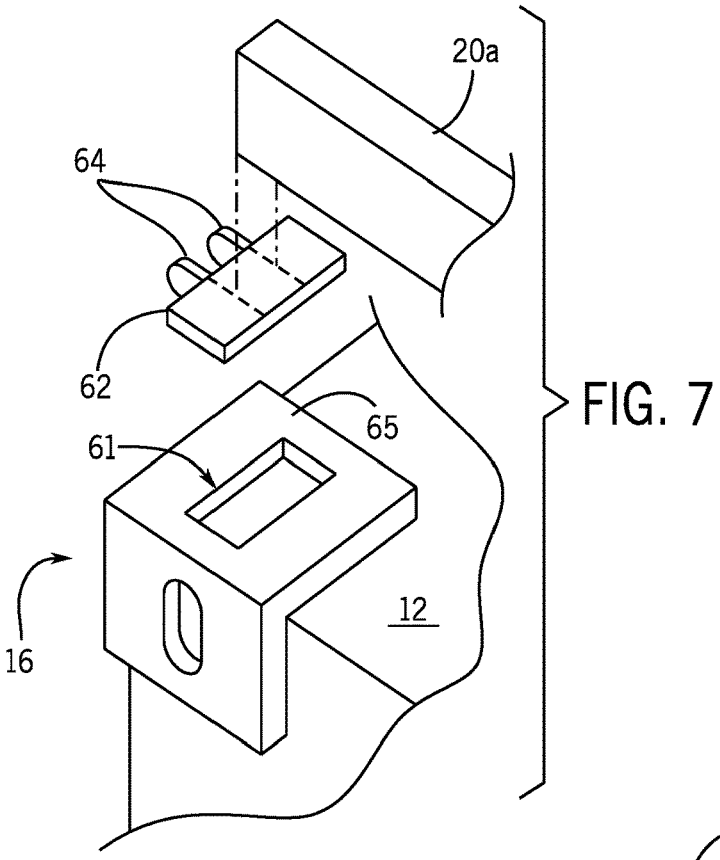
FIG. 7 is a fragmentary perspective view of a corner casting on a standard shipping container showing, in exploded form, a first end a second form of the rails of FIG. 2 attaching to the corner casting by teeth fitting within the corner casting.
Figure 8:
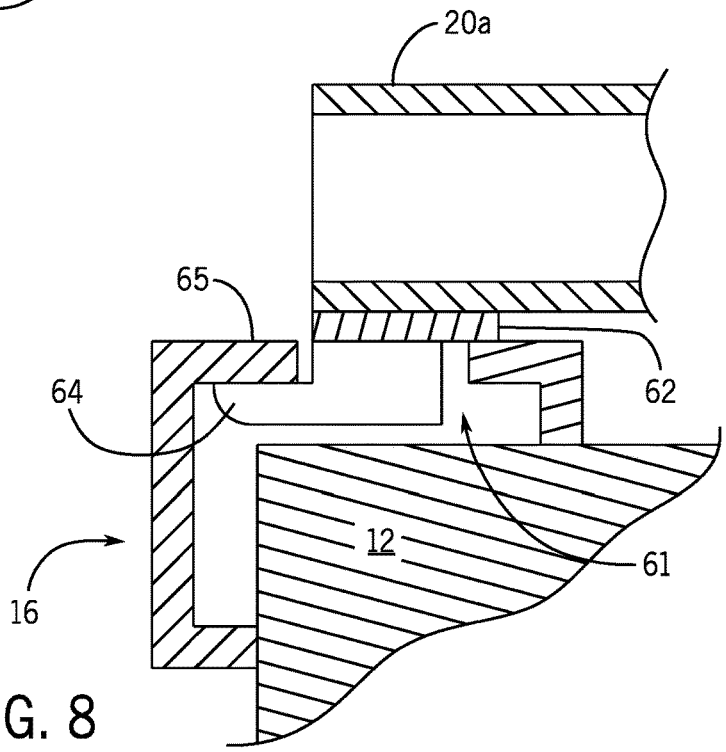
FIG. 8 is an elevational cross-sectional view through the corner casting showing engagement of the teeth beneath the surface of the corner casting.

Referring now to FIGS. 1, 7 and 8, in contrast, the first rails 20*a* may attach to the containers 12 by means of the corner castings 16 which provide an upwardly open longitudinally extended slot 61. A first end of each rail 20*a* may be attached to the corner casting 16 by means of a hook plate 62 having transversely extending hook teeth 64 which may be maneuvered beneath a lip 65 forming a transverse outer edge of the slot 61 by tipping the rail 20 downward toward the corner casting 16 to fit the hook teeth 64 beneath that lip 65 resisting upward motion of the rail 20*a* when the rail 20*a* is kept level with the top of the container 12. The hook plate 62 may be welded to a lower edge of one end of the rail 20*a*.

Figure 9:
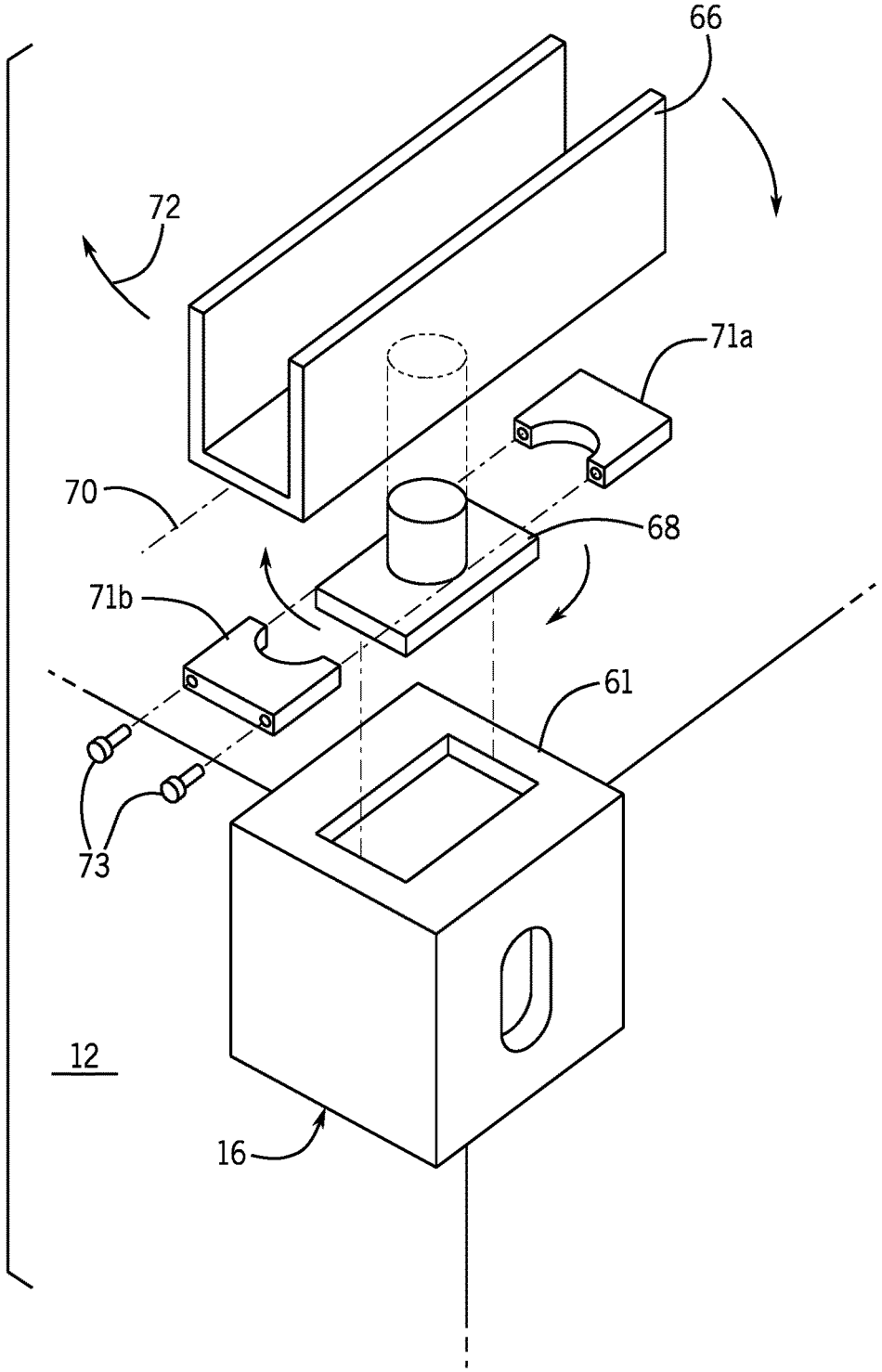
FIG. 9 is an exploded perspective view of a corner casting opposite the corner casting of FIG. 7 showing a twist lock T-fitting for engaging the second corner casting and then rotating it into a locked configuration.
Figure 10:
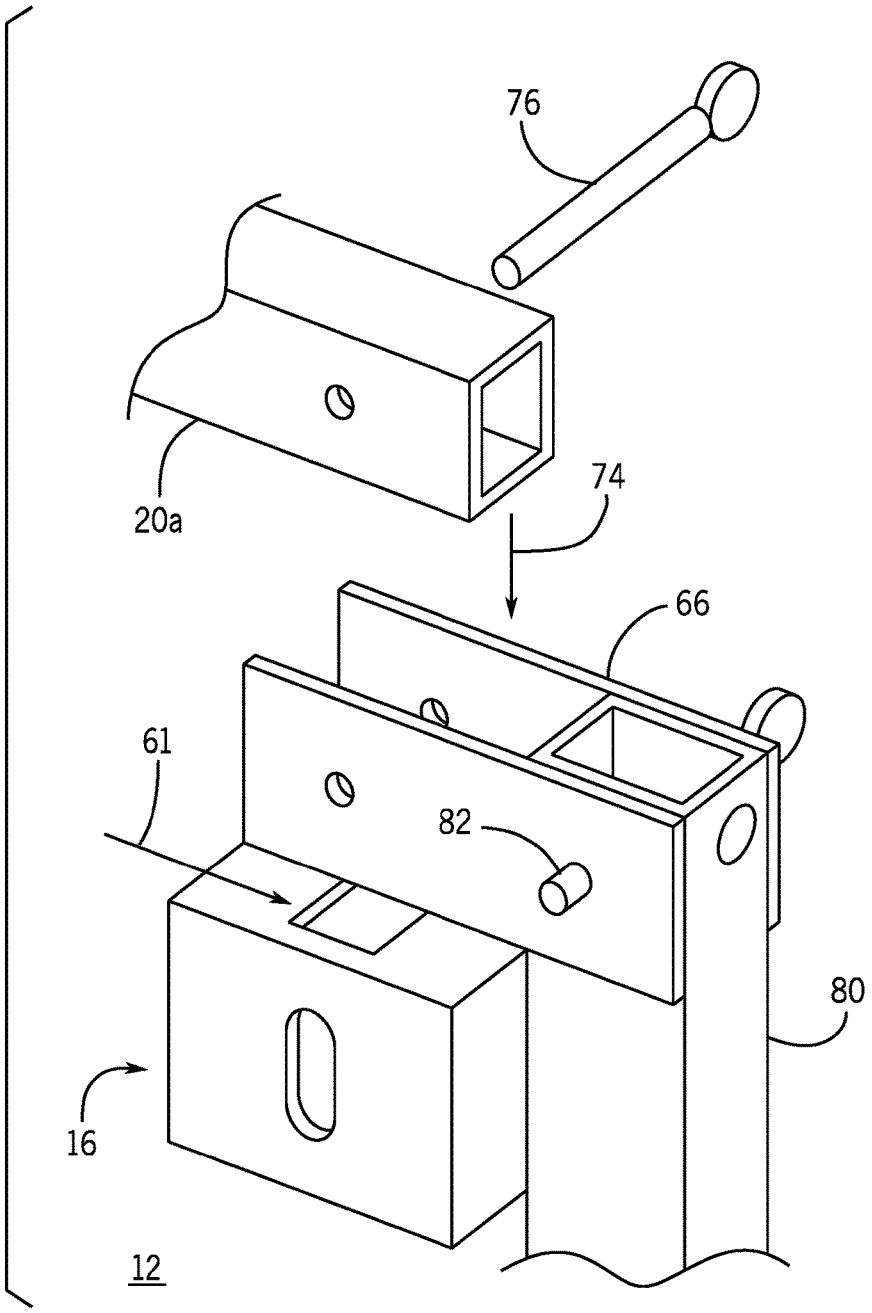
FIG. 10 is a fragmentary perspective view of the twist lock sleeve of FIG. 9 twisted into position and receiving the rail of FIGS. 7 and 8 and a vertical rail similar in construction to the rail of FIG. 7.

Referring now to FIGS. 9 and 10, the remaining end of rail 20*a* may be received within a swivel collar 66 providing an upwardly open U-channel sized to receive the rail 20*a*. The bottom of the swivel collar 66 may attach to a downwardly extending tee fitting 68 that may be received within the slot 61 of a corner casting 16 on the opposite end of the container 12 transversely opposed to the corner casting 16 of FIG. 7 when the swivel collar 66 has its channel axis 70 oriented longitudinally. A rotation of the swivel collar 66 (as indicated by arrow 72) so that channel axis 70 is transversely aligned, locks the tee fitting 68 after it is inserted through the slot 61, and hence locks the swivel collar 66 to the corner casting 16. At this time the rail 20*a* may be dropped into the collar 66 as indicated by arrow 74 and attached thereto by means of a clevis pin 76 or the like.

A swivel spacer 71 formed of halves 71*a* and 71*b* may fit around the downward shaft of the tee fitting 68 to freely rotate thereabout as attached together, for example, by machine screws 73. This swivel spacer 71 fills the length and width of the slot 61 of the corner casting 16 to resist movement of swivel collar 68 in the direction parallel to the walls of the containers 12 when the tee fitting 68 is engaged with the corner casting 16.

A portion of the swivel collar 66 extends beyond the end of the rail 20*a* in cantilever over an inner edge of a vertical wall of the container 12 to receive a vertical beam 80 extending vertically downward from a first end positioned within the swivel collar 66 and attached by pin 82. The opposite end of the vertical beam 80 may attach to a lower corner casting 16 directly below the corner casting 16 shown in FIG. 12 using the attachment mechanism shown with respect to FIGS. 7 and 8 albeit with the hook teeth 64 oriented vertically downward from the end of the vertical beam 80. The vertical beam 80 provides additional resistance against upward forces on the rail 20*a*, for example, from wind loads on the trusses 22, and also provides an attachment point for the end walls which will be now discussed.

Figure 11:
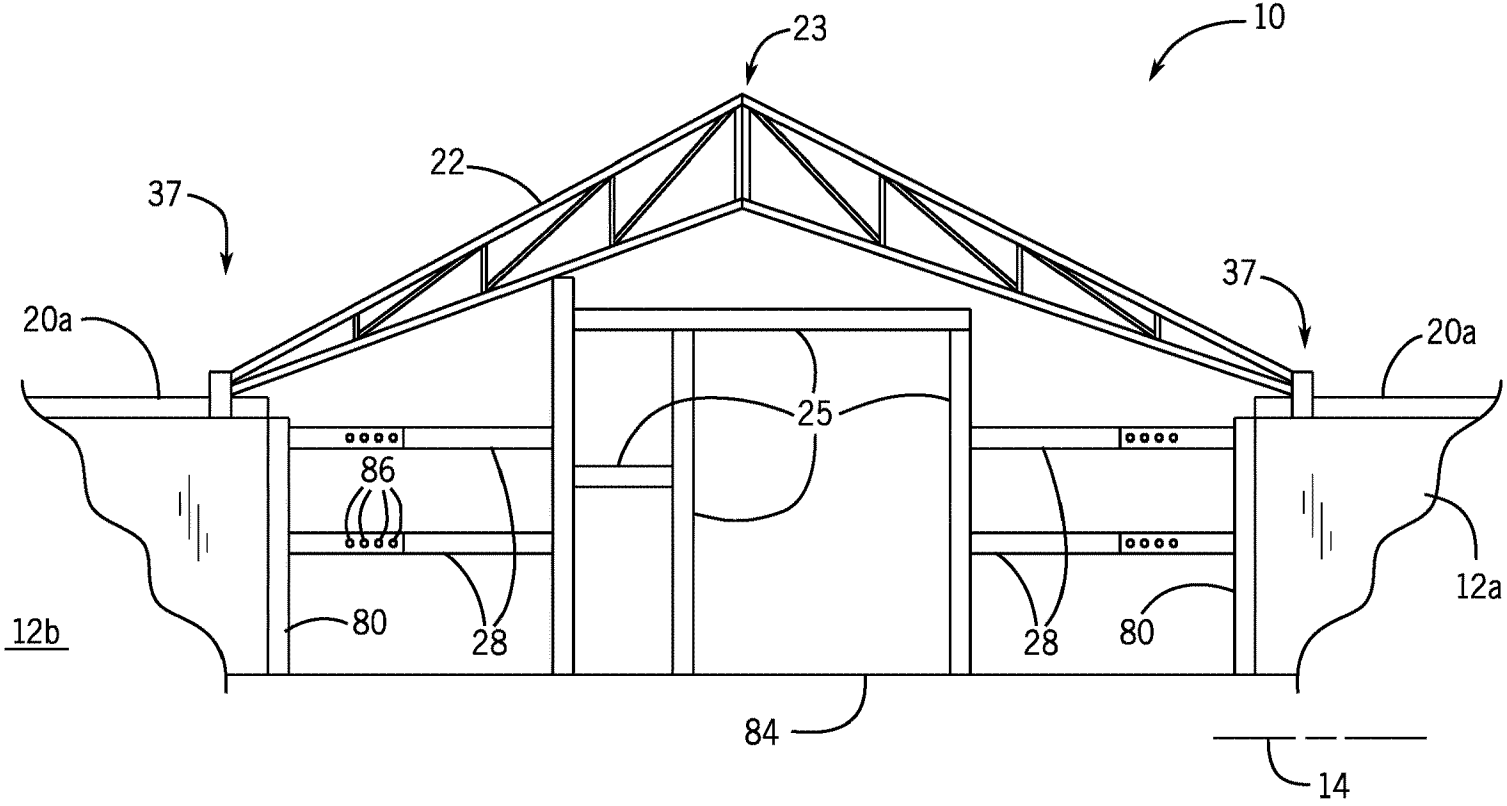
FIG. 11 is a front elevational view of the assembled structure showing the use of telescoping beams for completion of the end walls.

Referring now to FIG. 11, end walls of the structure 10 may be formed by prefabricated beams 25, as described above, extending from a sill plate 84 passing horizontally transversely along the ground between lower edges of the stabilizing beams 80 of the left and right flanking containers 12 as discussed above. These prefabricated beams 25 may be of known dimensions regardless of the separation of the containers 12 since their position approximately midway between the containers 12 is largely insensitive to precise separation of the containers 12. Accommodating variation in the separation of the containers 12 may be achieved by telescoping beams 28. These telescoping beams, for example, may be nested concentric square steel tubes whose length is adjusted and fixed by means of alignment of multiple holes 86 in one tube with a corresponding hole in the other two that may together receive a clevis pin or the like. The holes 86 successively line up with slotted holes in the outer tube (not shown) to provide a continuous range of locking adjustments.

The prefabricated beams 25 and stabilizing beams 80 may include keder rails 46 (not shown) described with respect to FIG. 4 to allow sheathing of the end walls with architectural fabric. The ends of the beams 28 and 25 may have flanges for receiving bolts attaching the flanges pre-drilled and tapped holes in the trusses 22, beams 25 or sill plate 84. Dimensions framed by the prefabricated beams 25 for the personnel door and garage door may be filled by those structures and/or prefabricated panels of known dimension.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What we claim is:

1. A building comprising:

a first and second shipping container separated along a first axis in spaced opposition flanking a building volume;

a set of rails extending parallel to the axis and releasably attached to upper surfaces of the first and second shipping containers;

a set of trusses extending between endpoints; and connectors attaching the endpoints of each truss to opposed, corresponding rails on the first and second shipping containers, the connectors attachable to the rails;

wherein the shipping containers provide corner castings standardized for the shipping industry and wherein at least one rail attaches between two corner castings;

wherein the at least one rail provides a hook at one end fitting within an upwardly open slot of a corner casting to engage an inner surface of the corner casting against upward motion of the rail.

2. The building of claim 1 wherein the connectors are adapted to releasably attach a range of positions along the rails.

3. The building of claim 2 wherein the connectors provide clamp surfaces receiving walls of the rails therebetween to slidably guide the connector along the rails and then to grip the rails with frictional force.

4. The building of claim 3 wherein the rails provide attachment to the shipping containers elevating the rails above a surface of the shipping container and wherein lower ends of the clamp surfaces include holes for receiving bolts therethrough adapted to draw the clamp surfaces together beneath the rails to clamp the clamp surfaces frictionally to a rail.

5. The building of claim 3 wherein the clamp surfaces are plates extending vertically downward from ends of the trusses.

6. The building of claim 1 wherein the rails are steel tubes.

7. The building of claim 1 wherein the at least one rail provides a rotatable T fitting within an upwardly open slot of the corner casting and rotating to engage an inner surface of the corner casting against upward motion of the rail.

8. The building of claim 7 wherein the rotatable T fitting is attached to a sleeve that engages the at least one rail.

9. The building of claim 1 wherein at least one of the rails provides downwardly extending fingers passing along vertical sidewalls of the shipping containers and adapted to grip the vertical sidewalls of the shipping container against upward motion of the rail.

10. The building of claim 9 wherein lower ends of the fingers include horizontally extending teeth for engaging corrugations in the sidewalls to limit motion perpendicular to the axis.

11. The building of claim 1 wherein the trusses are gable trusses angling upward from each shipping container to an apex point positioned between the shipping containers.

12. The building of claim 11 wherein the gable trusses are constructed of aluminum.

13. The building of claim 12 wherein the gable trusses each weigh less than 200 pounds.

14. The building of claim 1 wherein the trusses further include channels for receiving and retaining polymer sheet material to cover an upper surface of the trusses as a roof.

15. The building of claim 14 wherein the sheet material includes keders and wherein the channels provide keder channels for retaining the keders.

16. A building comprising:

a first and second shipping container separated along a first axis in spaced opposition flanking a building volume;

a set of rails extending parallel to the axis and releasably attached to upper surfaces of the first and second shipping containers;

a set of trusses extending between endpoints;

connectors attaching the endpoints of each truss to opposed, corresponding rails on the first and second shipping containers, the connectors attachable to the rails; and vertical columns attached to facing walls of the first and second shipping containers at ends of the first and second shipping containers.

17. The building of claim 16 wherein the vertical columns are configured to attach at both ends to vertically separate pairs of corner castings of the first and second shipping containers.

18. A method of constructing a building employing the components of:

a first and second shipping container;

a set of rails releasably attachable to upper surfaces of the first and second shipping containers;

a set of trusses extending between endpoints; and connectors attaching the endpoints of each truss to opposed, corresponding rails on the first and second shipping containers, the connectors attachable to the rails at a range of positions along the rails wherein the shipping containers provide corner castings standardized for the shipping industry and wherein at least one rail attaches between two corner castings and wherein the at least one rail provides a hook at one end fitting within an upwardly open slot of a corner casting to engage an inner surface of the corner casting against upward motion of the rail, the method comprising the steps of:

(a) placing the first and second shipping containers in separation along a first axis in spaced opposition flanking a building volume;

(b) attaching the set of rails to the upper surfaces of the first and second shipping containers to extend parallel to the axis and be separated from each other perpendicular to the axis; and (c) attaching the trusses to the rails using the connectors.

19. A shipping container connector assembly having corner castings attached to the shipping container, the shipping container connector assembly comprising:

a first rail attachable between two corner castings, a first end of the first rail having a hook fitting within an upwardly open slot of a first corner casting to engage an inner surface of the first corner casting against upward motion of the first rail and a second end of the first rail having a rotatable T fitting within an upwardly open slot of a second corner casting and rotating to engage an inner surface of the corner casting against upward motion of the first rail.

20. The connector system of claim 19 wherein the rotatable T fitting is attached to a sleeve that releasably engages the second end of the first rail.

21. The connector system of claim 20 further including a second rail attachable to the second end of the first rail to extend perpendicularly to the first rail to engage a third corner casting with a second hook fitting within an open slot of the third corner casting.

22. The connector system of claim 20 wherein the sleeve releasably engages the first rail and the second rail.

* * * * *